US005520298A

United States Patent [19]

Opanasenko

[11] Patent Number: 5,520,298

[45] Date of Patent: May 28, 1996

[54] METHOD OF DECORATING CONCRETE

[76] Inventor: Walter Opanasenko, 486 2nd St., Bay Port, Mich. 48720

[21] Appl. No.: 127,516

[22] Filed: Sep. 28, 1993

[51] Int. Cl.[6] ..... B28B 1/16

[52] U.S. Cl. ..... 216/39; 216/30; 216/96; 264/245

[58] Field of Search ..... 264/245, 73, 74, 264/256, 77; 156/61, 645, 654, 655, 659.1, 657; 427/393.6; 216/30, 39, 96, 99

[56] References Cited

U.S. PATENT DOCUMENTS 716,371 12/1902 Black et al. .
3,058,164 10/1962 Rowe .
3,795,721 3/1974 Gilbert et al. .
4,043,826 8/1977 Hum .
4,769,191 9/1988 Diana .
5,372,676 12/1994 Lowe .

*Primary Examiner*—Karen Aftergut
*Attorney, Agent, or Firm*—John J. Swartz

[57] ABSTRACT

A method of decorating concrete including the steps of mixing water, aggregate and cement to provide mortar, pouring the mortar into a form and allowing it to cure and harden into a concrete block having an exterior surface, and applying sulfate to a selected portion of the block to color the surface of the block to a predetermined depth while the mortar is being cured.

6 Claims, 2 Drawing Sheets

METHOD OF DECORATING CONCRETE

BACKGROUND OF THE INVENTION

1. Field of the Invention

This invention relates to a method of decorating concrete and more particularly to a decorative concrete block and method of coloring selected portions of a concrete block to decorate the block.

2. Description of the Prior Art and Objects

Concrete blocks are typically formed by mixing water, aggregate and cement in a slurry form, pouring the mortar slurry into a block mold and allowing the mortar to cure. The mold and formed, curved block are later separated.

The prior art concrete blocks are aesthetically boring and normally utilized as structural foundation elements such as in forming the foundations of buildings. It has been found, according to the present invention, that concrete blocks can be decorated and utilized in the interior of homes for floors, entry ways, fireplace fronts and/or patio surfaces. Accordingly, it is an object of the present invention to provide a decorative concrete block which can be utilized as an attractive building element in residential and commercial settings.

It is another object of the present invention to provide a new and novel decorated concrete block and the method of making concrete which will decorate concrete to make it aesthetically pleasing.

It has been found that concrete blocks having different colors are important in the building trade. One such way of decorating blocks is merely to apply a color to the exterior surface of the block, however, coloring, such as paint, is easily removed from the block. Accordingly, it is an object of the present invention to provide a block of decorative concrete and method of decorating concrete which will color the block to a predetermined depth below the surface of the block.

It has been found, according to the present invention, that concrete can be appropriately colored by adding a sulfate to a portion of the surface of the block in a desired pattern while the mortar is being cured.

Accordingly, it is an object of the present invention to provide decorative concrete and method of forming decorative concrete by applying sulfate to a portion of the surface of a concrete block while the mortar is curing to color a portion of the block to a predetermined depth below the surface of a block.

Other objects and advantages of the present invention will become apparent to those of ordinary skill in the art as the description thereof proceeds.

SUMMARY OF THE INVENTION

A decorative concrete block comprising a block of concrete having an outer surface of a predetermined color, a decorative pattern of a different color provided in a selected portion of the outer surface and extending to a predetermined depth below the outer surface. The block is formed by mixing water, aggregate and cement to provide mortar, pouring the mortar into a form to cure and harden into a concrete block having an exterior surface; and coloring a selected portion of the block to a predetermined depth below the exterior surface in a predetermined pattern to decorate the block as the mortar is being cured.

DESCRIPTION OF THE DRAWINGS

The invention may be more readily understood by referring to the accompanying drawings, in which.

DESCRIPTION OF THE PREFERRED EMBODIMENT

Figure 1:
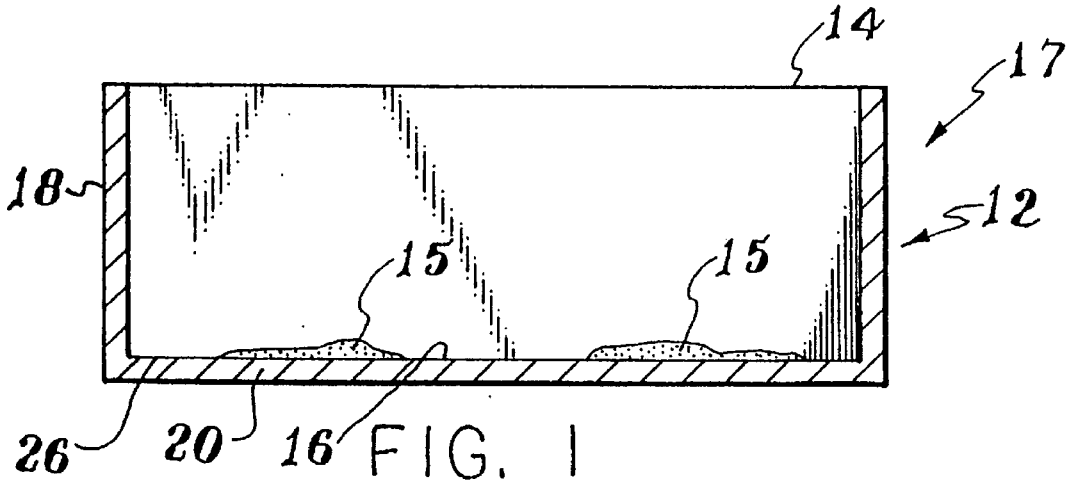
FIG. 1 is a sectional side view of a mold or form, including a coloring material located therein, into which mortar is poured to form a block according to the present invention.

A concrete block constructed according to the present invention, generally designated 10, is formed in a mold, generally designated 12, having a side wall 18 joined to a bottom wall 20 and having an open top 14.

A coloring material, generally designated 15, is sprinkled or otherwise placed along the upper surface 16 of the bottom wall 20 in a predetermined pattern. The coloring material 15 would suitably comprise sulfate such as copper sulfate, iron sulfate, aluminum sulfate, or any other sulfate material. Aluminum sulfate is commercially available and sold under the trademark ORTHO manufactured by Chevron Chemical Company, P.O. Box 5047, San Ramon, Calif., as Formula 1000. This product includes hydrated aluminum sulfate (100 percent) and aluminum (as AL nine percent) derived from hydrated aluminum sulfate.

Another of the sulfates could comprise the product as known as crystal blue vitriol, sold by Durham's Drug Products Company, Brownwood, Tex. 76801, which includes 99 percent copper sulfate and one percent inert ingredients.

Another suitable sulfate is copperas, which is iron sulfate sold under the trademark HIGH YIELD by Voluntary Purchasing Groups Inc., Bonham, Tex. 75418. The HIGH YIELD product comprises 11 percent combined sulfur and 19 percent FE (iron) derived from parisulfate.

Copperas products are also sold under the trademark WONDER GROW by Wonder Chemical Company, Livingston, Tex. which has 20 percent FE (iron) and 12 percent sulfur.

The coloring material 15 may comprise different combinations of different sulfates, such as aluminum sulfate, copper sulfate, or iron sulfate.

The block 10 is formed by mixing cement, water and aggregate such as sand, gravel, crushed stone and/or marble dust 19 and fibrous material, generally designated 21, to form a mortar slurry 22. The fibrous material 21 may comprise fiber mesh reinforcement such as fiberglass to increase the strength. The fiber mesh and aggregate is not necessary but is utilized to increase strength of the block.

Figure 2:
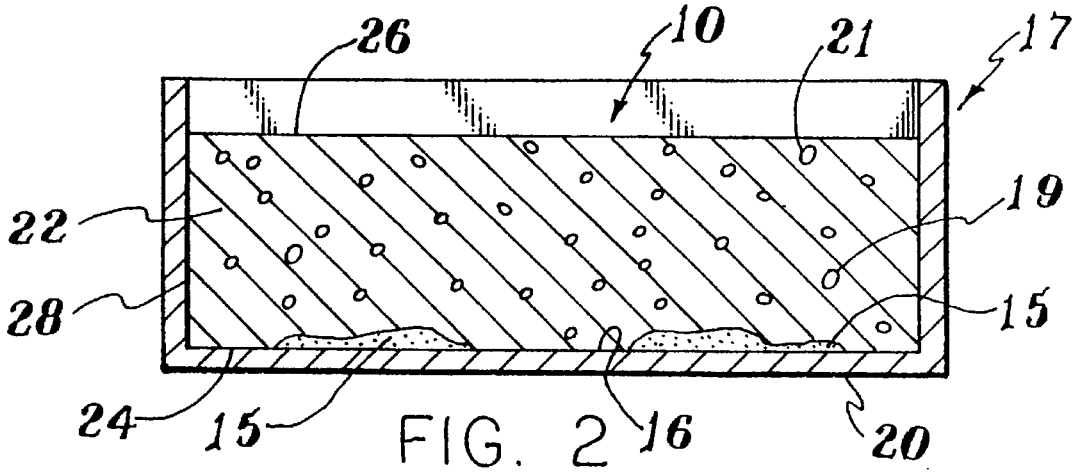
FIG. 2 is a sectional side view, similar to FIG. 1, illustrating a mold or form after mortar slurry has been poured therein over the coloring material.

The block 10 includes an outer surface having a top surface 24, bottom surface 26, end surfaces 28 and side surfaces 30. As illustrated in FIG. 2, the block is formed "upside down" with the top surface 24 initially being lowermost and abutting the top surface 16 of bottom wall 20 during formation of the block while the mortar is curing and hardening. The sulfate 15 reacts with the mortar to color the mortar to a depth 32 to provide a decorative colored surface 34 which is aesthetically pleasing and may be utilized in decorating buildings.

The decoration, represented by the surface area 34, may be any selected pattern to cover any selected portion of the outer surface of the block 10.

THE METHOD

Sulfate, such as copper sulfate, iron sulfate, or aluminum sulfate 15 is sprinkled or randomly placed along the top surface 16 of the bottom wall 20 of a mold 12.

Figure 5:
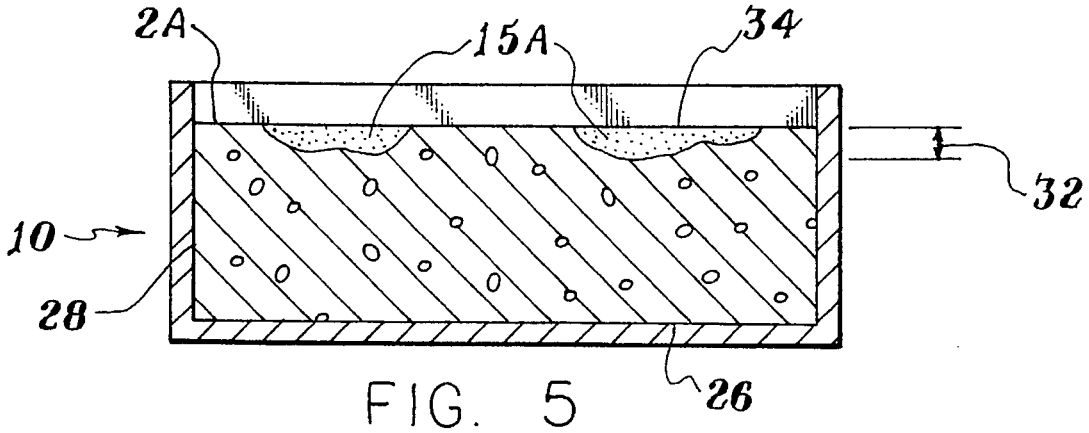
FIG. 5 is a sectional side view illustrating a finished block after the sulfate has impregnated and colored surface portions thereof.
Figure 6:
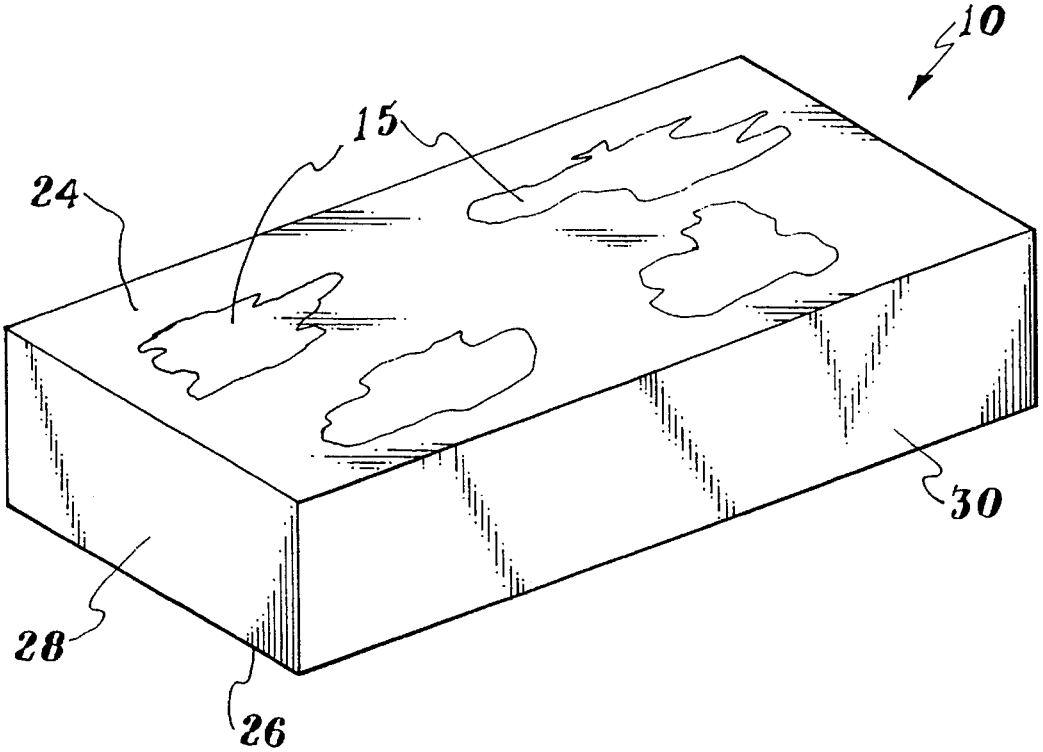
FIG. 6 is a perspective view of a finished block.

Thereafter, a mortar slurry comprising an admixture of water, concrete and sand, gravel, crushed stone and/or marble dust is poured into the mold as illustrated in FIG. 2. The mortar is allowed to cure, set and harden after which the mold is tipped upside down and the block removed. During the curing and hardening process, the sulfate 15 will stain and/or etch a pattern 34 into the upper surface 24 into which the sulfate comes in contact. The pattern can be controlled depending on the amount and placement of the sulfate along the bottom wall 20 of the mold. If sufficient sulfate is utilized, it will actually etch a recess into the stained area 34 to provide a recess in the top wall 24 as illustrated in FIG. 5.

ALTERNATE EMBODIMENT

Figure 3:
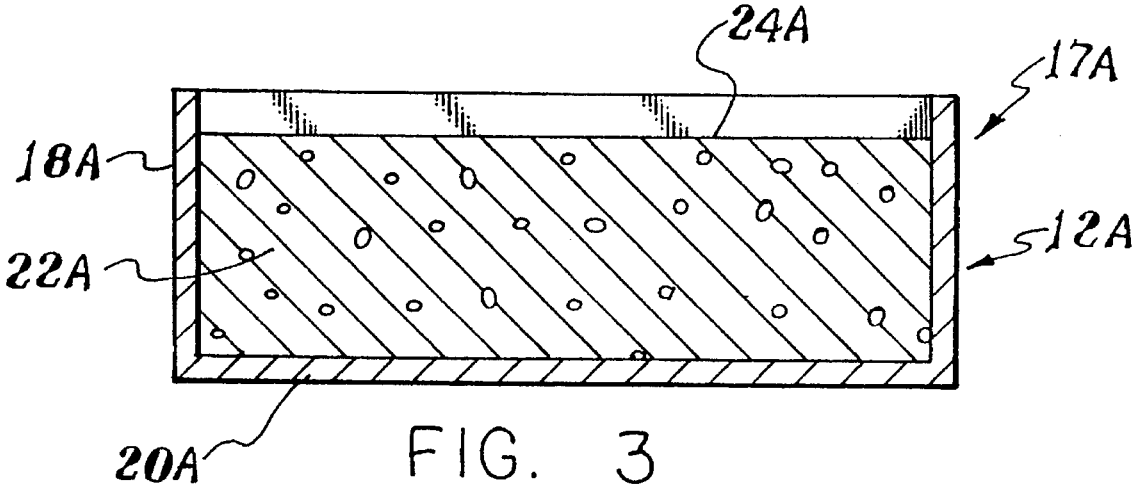
FIG. 3 is a sectional side view similar to FIG. 1 illustrating a mold without any coloring material therein but having mortar poured therein.

Referring now more particularly to FIG. 3, parts corresponding to those previously described parts, will be referred to by corresponding reference characters followed by the letter subscript A.

Figure 4:
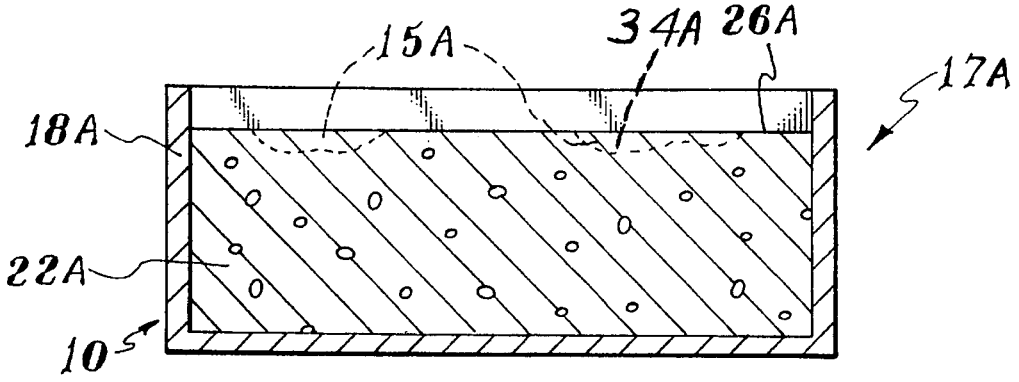
FIG. 4 is a sectional side view similar to FIG. 3 illustrating coloring material being added to the mortar while it is being cured.

The process utilized in connection with the block formed in FIGS. 3 and 4 allows the mortar 22A to be first poured into the mold 12A and thence the sulfate 15A is added to the upper surface 24A of the mortar. The sulfate will react with the mortar while it is being cured to etch and/or color the block to a predetermined depth below the surface 24A as illustrated by the chain lines 34A.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A method of decorating concrete comprising the steps of:

mixing water, aggregate, and cement to provide mortar in a slurry form;

pouring said mortar into a mold to cure and harden into a block of concrete having an exterior surface;

applying sulfate to a portion of said exterior surface in a predetermined pattern while said mortar is curing to etch and color said portion of said exterior surface to a predetermined depth below said portion of said exterior surface and, thus, decorate said exterior surface of said block of concrete; and separating said decorated block of concrete from said mold;

said applying step being accomplished by depositing said sulfate in said mold prior to pouring said mortar into said mold.

2. The method set forth in claim 1 wherein said sulfate comprises copper sulfate.

3. The method set forth in claim 1 wherein said sulfate is selected from the group consisting of copper sulfate, iron sulfate, and aluminum sulfate.

4. The method set forth in claim 3 wherein said mixing step includes the step of mixing fibrous material with said water, aggregate and cement.

5. The method set forth in claim 4 wherein said step of mixing fibrous material includes step of mixing fiber mesh material with said water, aggregate and cement.

6. A method of decorating concrete comprising the steps of:

mixing water, aggregate and cement to provide mortar in slurry form;

pouring said mortar into a form to cure and harden into a concrete block having an exterior surface; and coloring a selected portion of said concrete block to a predetermined depth below said exterior surface in a predetermined pattern to decorate said concrete block as said mortar is being cured;

said coloring step including simultaneously coloring sections of said concrete block in different colors;

said coloring step being accomplished by depositing sulfate into said form prior to said pouring step.

* * * * *